US006076820A

United States Patent [19]

Nagai et al.

[11] Patent Number: 6,076,820

[45] Date of Patent: Jun. 20, 2000

[54] ROTATION TRANSFER DEVICE AND PAPER FEEDING APPARATUS AND IMAGE FORMING APPARATUS USING THE ROTATION TRANSFER DEVICE

[75] Inventors: Seiji Nagai, Hyogo; Hiroaki Yoshida, Kanagawa, both of Japan

[73] Assignee: Fujitsu Limited, Kawasaki, Japan

[21] Appl. No.: 09/066,903

[22] Filed: Apr. 28, 1998

[30] Foreign Application Priority Data

Dec. 19, 1997 [JP] Japan ..... 9-351459

[51] Int. Cl.[7] ..... B65H 55/22; T16D 1/00

[52] U.S. Cl. ..... 271/4.01; 271/6; 271/198; 271/314; 198/789; 198/835; 403/327

[58] Field of Search ..... 198/583, 789, 198/835; 403/326, 327, 328; 285/317; 271/6, 4.06, 4.07, 4.09, 4.1, 4.01, 314, 198, 272; 464/DIG. 901

[56] References Cited

U.S. PATENT DOCUMENTS

| | | | |
|---|---|---|---|
| 779,479 | 1/1905 | Howell | 285/317 |
| 4,131,153 | 12/1978 | Schmid | 198/789 |
| 4,943,182 | 7/1990 | Hoblingre | 403/328 |
| 5,128,715 | 7/1992 | Furuyama et al. | 355/200 |
| 5,669,046 | 9/1997 | Yoshida et al. | 399/167 |
| 5,695,186 | 12/1997 | Phillips et al. | 271/314 |

FOREIGN PATENT DOCUMENTS 8-87225 4/1996 Japan .

*Primary Examiner*—H. Grant Skaggs
*Attorney, Agent, or Firm*—Armstrong, Westerman, Hattori, McLeland & Naughton

[57] ABSTRACT

In a rotation transfer device, a paper feeding apparatus and an image forming apparatus, transfer projections are disposed on coupling members provided on the ends of a driving shaft and a driven shaft, so that the movement of one transfer projection in the peripheral direction can be constrained by the other transfer projection and a positioning member. Thus, rotation irregularity caused by reverse rotation torque applied by a function from the side of paper can be prevented.

18 Claims, 9 Drawing Sheets

ROTATION TRANSFER DEVICE AND PAPER FEEDING APPARATUS AND IMAGE FORMING APPARATUS USING THE ROTATION TRANSFER DEVICE

BACKGROUND OF THE INVENTION

The present invention relates to a rotation transfer device for coupling a driven shaft and a driving shaft removably in the axial direction, and a paper feeding apparatus and an image forming apparatus including the rotation transfer device in which paper is fed along a predetermined feed path by using rotation of a feed roller.

An image forming apparatus, such as a copying machine and a printer device, in which an image is formed on paper, fed through a feed path from a paper supply unit to a paper discharge unit, by an operation of a print unit disposed on the feed path includes a paper feeding apparatus for feeding the paper by using rotation of a feed roller facing on the feed path.

The feed roller is connected with a motor shaft of a driving motor fixed within the body of the image forming apparatus through an appropriate rotation transfer device, so as to be driven by the motor. When a gear or a timing belt is used as the rotation transfer device, rotation irregularity can be unavoidably caused due to back crash.

In particular, when the rotation irregularity is caused in an image forming apparatus for forming a multicolored image in which print units corresponding to respective colors, i.e., black, yellow, magenta and cyan, are aligned along the feed path, a printing position can be shifted in the respective print units, resulting in disadvantageously degrading printing quality. Therefore, a rotation transfer device for directly coupling the roller shaft of the feed roller and the motor shaft of the driving motor through a coupling is used for preventing the rotation irregularity.

Also, in the paper feeding apparatus, in order to ease maintenance, inspection and exchange of the feed roller, which is unavoidably degraded with time, the feed roller or a feed unit including the feed roller can be taken out of the body of the image forming apparatus. Furthermore, in a practically used paper feeding apparatus, the feed roller or unit can be removed by drawing the transfer roller in the axial direction without affecting other composing members.

In order to make the feed unit removable by drawing the feed roller, it is necessary to couple the roller shaft (a driven shaft) of the feed roller with the motor shaft (a driving shaft) of the driving motor fixed within the body of the image forming apparatus removably in the axial direction. As a rotation transfer device with a simple structure enabling such removable coupling, one as is shown in FIG. 1 is conventionally used.

In FIG. 1, a reference numeral 1 denotes a roller shaft, that is, a driven shaft, of a feed roller, a reference numeral 2 denotes a motor shaft, that is, a driving shaft, of a driving motor. These shafts are respectively coaxially provided, at their ends, with coupling members 1*a* and 2*a* each in the shape of a short cylinder having substantially the same diameter. On the opposing faces of the coupling members 1*a* and 2*a*, transfer pins 1*b* and 2*b* are projected toward each other in positions away from the axial centers by substantially the same distance. The coupling member 2*a* is rotated in accordance with the rotation of the motor shaft 2, and the transfer pin 2*b*, which moves along a predetermined circle in accordance with the rotation, comes to a contact with the transfer pin 1*b* on the same circle as is shown in FIG. 1, so as to push the transfer pin 1*b* in the peripheral direction.

Thus, the rotation of the motor shaft 2 is transferred to the coupling member 1*a* and the roller shaft 1.

Since these coupling members 1*a* and 2*a* are not at all constrained in the axial direction of the roller shaft 1, they can be easily removed from each other by moving the roller shaft 1 away from the motor shaft 2. Thus, the feed roller can be drawn. The feed roller can be any roller which can directly or indirectly feed paper, such as a sensitive drum used in an electrophotographic image forming apparatus and a driving roller of a transfer belt extended along the feed path.

Furthermore, when the feed roller having been drawn is pushed in again and the coupling members 1*a* and 2*a* are positioned to be close to and oppose each other by moving the roller shaft 1 toward the motor shaft 2, the rotation of the motor shaft 2 can be transferred to the roller shaft 1 again. At this point, the transfer pins 1*b* and 2*b* are not required to be positioned in the peripheral direction, but the rotation transfer can be attained merely by pushing the roller shaft 1 in.

The feed roller in an operation in the paper feeding apparatus, however, is supplied with rotation torque in the reverse direction to the driving direction of the driving motor by a function from the paper to be fed, and the rotation torque is varied. Therefore, when the rotation transfer device of FIG. 1 is used, the variation of the rotation torque can move the transfer pins 1*b* and 2*b* toward and away from each other, thereby causing the rotation irregularity. As a result, the aforementioned problem can occur.

On the other hand, Japanese Patent Application Laid-Open No. 8-87225 (1996) discloses a rotation transfer device which can removably couple a sensitive drum used in an electrophotographic image forming apparatus with a motor shaft of a driving motor. The rotation transfer device is disposed at an axial center portion of the sensitive drum, and includes a recess having internal teeth in the shape of a bevel gear, a male type member, having external teeth in the shape of a bevel gear along its periphery, which is fit around the motor shaft movably in the axial direction, and a compression spring for pushing the male type member in a direction toward its tip. The male type member is fit in the recess by a force applied by the compression spring, so as to transfer rotation through engagement between the external teeth of the male type member and the internal teeth of the recess.

Also in this rotation transfer device, the coupling can be released by drawing the sensitive drum in the axial direction as in the rotation transfer device of FIG. 1. Also, when the sensitive drum is pushed in and the motor is appropriately driven, the male type member moves forward by the function of the compression spring to be fit in the recess for attaining the coupling. Furthermore, since the coupling is attained by the engagement of the bevel gears, a shift and inclination in the axial centers between the sensitive drum and the motor can be absorbed, resulting in realizing definite coupling.

This rotation transfer device, however, requires precisely processed members such as the recess having the internal teeth and the male type member having the external teeth, and the structure is disadvantageously complicated. In addition, it is impossible to avoid rotation irregularity from being caused by back crash between the internal teeth and the external teeth. Therefore, when this rotation transfer device is used in the above-described multicolored image forming apparatus, it is difficult to retain good printing quality.

BRIEF SUMMARY OF THE INVENTION

The present invention was devised in view of the aforementioned problems. One object of the invention is providing a rotation transfer device for removably coupling a driven shaft and a driving shaft with a simple structure enabling effective prevention of rotation irregularity. Another object is providing, through use of the rotation transfer device, a paper feeding apparatus in which paper can be fed without dislocation and an image forming apparatus in which printing quality can be improved.

The rotation transfer device of this invention comprises a driving shaft; a driven shaft; coupling members respectively provided on ends of the driving shaft and the driven shaft, through which the driven shaft and the driving shaft are removably coupled with each other; transfer projections respectively projected from opposing faces of the coupling members on a common circle away from axial centers of the coupling members, which are brought to a contact with each other for rotation transfer; a positioning member provided on one of the coupling members movably toward and away from the opposing face of the other coupling member, which is moved in a projecting direction to constrain movement of the transfer projection on the opposing coupling member in a direction away from the transfer projection on the coupling member having the positioning member, and is moved in a recessing direction to allow movement of the transfer projection of the opposing coupling member in a direction toward the transfer projection on the coupling member having the positioning member; and force applying means for applying a force to the positioning member in the projecting direction.

Accordingly, the rotation is transferred from the driving shaft to the driven shaft through the transfer projections, which are disposed on the coupling members respectively provided on the driven shaft and the driving shaft and come in contact with each other in a position away from the axial center. The coupling member on the driven shaft or the driving shaft is provided with not only the transfer projection but also the positioning member movably toward the other coupling member. The transfer projection on the other coupling member is nipped between the transfer projection and the positioning member formed on the same coupling member, so as to constrain its movement in the peripheral direction. In this manner, the transfer projections can be prevented from being moved toward or away from each other by reverse rotation torque applied by a function from the driven shaft, and the rotation can be transferred without the rotation irregularity.

The transfer projection and the positioning member on the same coupling member do not constrain movement of the opposing transfer projection in the axial direction, and hence, the coupling between the driven shaft and the driving shaft can be released by drawing the driven shaft in the axial direction. Also, when the driven shaft is moved in the axial direction so as to position the coupling members on these shafts close to each other and the driving shaft is appropriately rotated, the transfer projections can come into contact with each other. Thus, the driven shaft and the driving shaft can be coupled for attaining the rotation transfer. At this point, the positioning member is moved in the recessing direction, so that the opposing transfer projection can move in the peripheral direction in accordance with the rotation of the driving shaft. Then, the transfer projections come into contact with each other, and the positioning member is moved in the projecting direction by the force applied by the force applying means, so that the opposing transfer projection can be nipped between the transfer projection and the positioning member on the same coupling member.

In the rotation transfer device of this invention, one of the coupling members provided on the driven shaft or the driving shaft includes a taper portion projected from an axial center thereof with a smaller diameter toward a tip thereof, and the other coupling member includes a positioning hole formed at an axial center thereof to be fit with the taper portion when the driven shaft and the driving shaft are coupled.

Accordingly, when the driven shaft is pushed in for attaining the coupling, the taper portion formed at the tip of the driven shaft or the driving shaft is fit in the positioning hole formed in the axial center of the opposing coupling member. Thus, a shift and inclination of the axial centers between the driven shaft and the driving shaft can be absorbed, so that they can be coaxially positioned. Thus, the rotation can be definitely transferred.

In the rotation transfer device of this invention, a point where the taper portion is fit in the positioning hole is in substantially the same position in the axial direction as a point where the transfer projections are in contact with each other.

In this manner, the point where the transfer projections are in contact, namely, the point of application of the rotation power transferred from the driving shaft to the driven shaft, is set in substantially the same position as the point where the taper portion is fit in the positioning hole, namely, the point of support in the coupling between these shafts. Therefore, the rotation power can be collected in the peripheral direction, and the driving shaft and the driven shaft are not supplied with unnecessary power through the rotation transfer.

In the rotation transfer device of this invention, one of the coupling members includes second force applying means provided movably in an axial direction of the corresponding shaft, and the second force applying means applies a force to the coupling member including the second force applying means in a direction toward the other coupling member.

Accordingly, when the driven shaft is insufficiently pushed in for the coupling with the driving shaft, the coupling member provided on one of the shafts is moved in the axial direction by the force applying means so as to come close to the other coupling member. Thus, the transfer projections come in contact for enabling the rotation transfer. In this manner, a state where the rotation cannot be transferred due to incomplete assembly can be avoided.

Alternatively, the paper feeding apparatus of this invention comprises a feed path for paper; a driven shaft working as a roller shaft of a feed roller facing on the feed path; a driving shaft working as a motor shaft of a motor for driving the feed roller, which rotates the feed roller by the driving thereof for directly or indirectly feeding the paper; and the respective composing members of the rotation transfer device described above.

Accordingly, the rotation transfer device having the aforementioned functions is used as a transfer system from the driving motor to the feed roller for the paper, and a feed unit including the feed roller can be taken out by drawing the unit in the axial direction. Thus, maintenance, inspection and exchange can be eased, and the feed roller can be rotated without rotation irregularity. As a result, the paper can be fed without dislocation.

Alternatively, the image forming apparatus of the invention comprises a feed path for paper disposed between a paper supply unit and a paper discharge unit and including a print unit for forming an image; a driven shaft working as a roller shaft of a feed roller facing on the feed path; a driving shaft working as a motor shaft of a motor for driving the feed roller, which rotates the feed roller by the driving thereof for directly or indirectly feeding the paper; and the respective composing members of the aforementioned paper feeding apparatus.

Accordingly, paper used for recording in the image forming apparatus can be fed by using the paper feeding apparatus without dislocation, and hence, the printing quality can be improved. Also, since the feed roller and a feed unit including the feed roller can be taken out by drawing them in the axial direction, the maintenance, inspection and exchange of the feed system can be eased.

The above and further objects and features of the invention will more fully be apparent from the following detailed description with accompanying drawings.

DETAILED DESCRIPTION OF THE INVENTION

Figure 2:
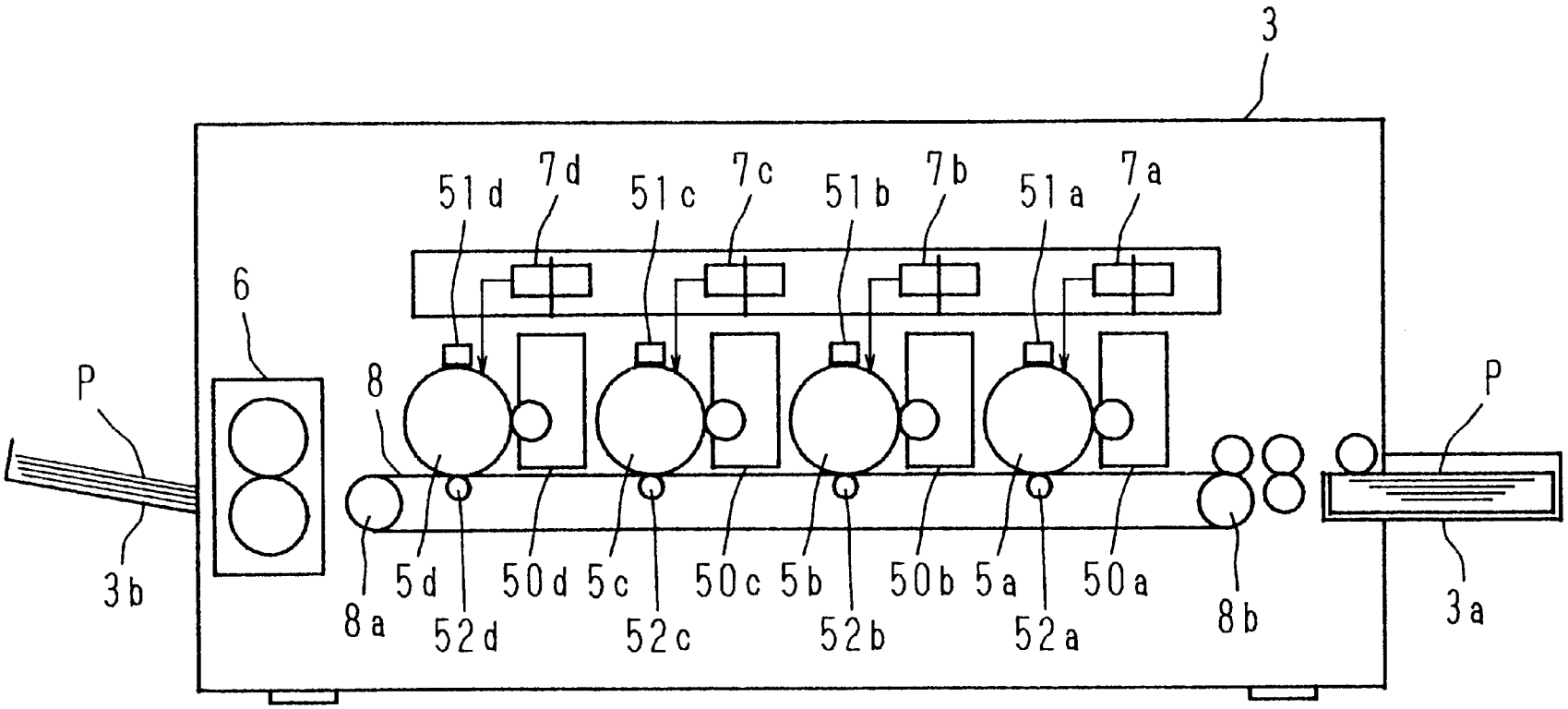
FIG. 2 is a side sectional view of an image forming apparatus including a paper feeding apparatus according to the invention.

The present invention will now be described with reference to drawings illustrating embodiments thereof. FIG. 2 is a schematic side sectional view for showing the entire structure of an image forming apparatus for forming a multicolored image including a paper feeding apparatus of the invention.

The image forming apparatus includes, in an outer housing 3, a feed path for paper P disposed between a paper supply unit 3*a* externally provided at one side and a paper discharge unit 3*b* externally provided at the other side. Along the feed path, sensitive drums 5*a*, 5*b*, 5*c* and 5*d* corresponding to respective colors, i.e., black, yellow, magenta and cyan, and a fixer 6 are aligned. Above the sensitive drums 5*a*, 5*b*, 5*c* and 5*d*, optical devices 7*a*, 7*b*, 7*c* and 7*d* for exposure are disposed correspondingly to the respective colors.

Around the sensitive drums 5*a*, 5*b*, 5*c* and 5*d*, known equipment required for the image formation, such as developers 50*a*, 50*b*, 50*c* and 50*d* containing toner of the respective colors, chargers 51*a*, 51*b*, 51*c* and 51*d* for charging the circumferential surfaces of the corresponding drums, and transfer devices 52*a*, 52*b*, 52*c* and 52*d* in the shape of rollers for sandwiching the paper P together with the photosensitive drums 5*a*, 5*b*, 5*c* and 5*d*, are disposed so as to face the circumferential surfaces of the corresponding drums.

In the image forming apparatus having the aforementioned structure, electrostatic latent images corresponding to the respective colors are formed on the circumferential surfaces of the sensitive drums 5*a*, 5*b*, 5*c* and 5*d* having been charged by the chargers 51*a*, 51*b*, 51*c* and 51*d* through the exposure by the optical devices 7*a*, 7*b*, 7*c* and 7*d*. The latent images are developed by the developers 50*a*, 50*b*, 50*c* and 50*d*, and successively transferred onto the paper sandwiched between the sensitive drums and the transfer devices 52*a*, 52*b*, 52*c* and 52*d*, so as to form a multicolored image. The resultant image is fixed on the paper P by the operation of the fixer 6 disposed downstream. In this manner, the multicolored image is formed on the paper P fed from the paper supply unit 3*a* along the feed path, and the paper P bearing the image is discharged from the paper discharge unit 3*b*.

In this image forming apparatus, the main part of the paper feeding apparatus for feeding the paper P is formed as a transfer belt device as is shown in FIG. 2. In the transfer belt device, a transfer belt 8 is stretched between a feed roller 8*a* and a driven roller 8*b* disposed on both sides of the aligned sensitive drums 5*a*, 5*b*, 5*c* and 5*d*, so that the transfer belt 8 can be substantially parallel to the sensitive drums 5*a*, 5*b*, 5*c* and 5*d*. The paper P fed from the paper feed unit 3*a* is placed on the transfer belt 8 to be fed in accordance with the drive of the transfer belt 8, so as to successively reach the sensitive drums 5*a*, 5*b*, 5*c* and 5*d* where images of the respective colors are formed. In the paper feeding apparatus, a rotation transfer device of the invention is used for driving the feed roller 8*a*.

Figure 3:
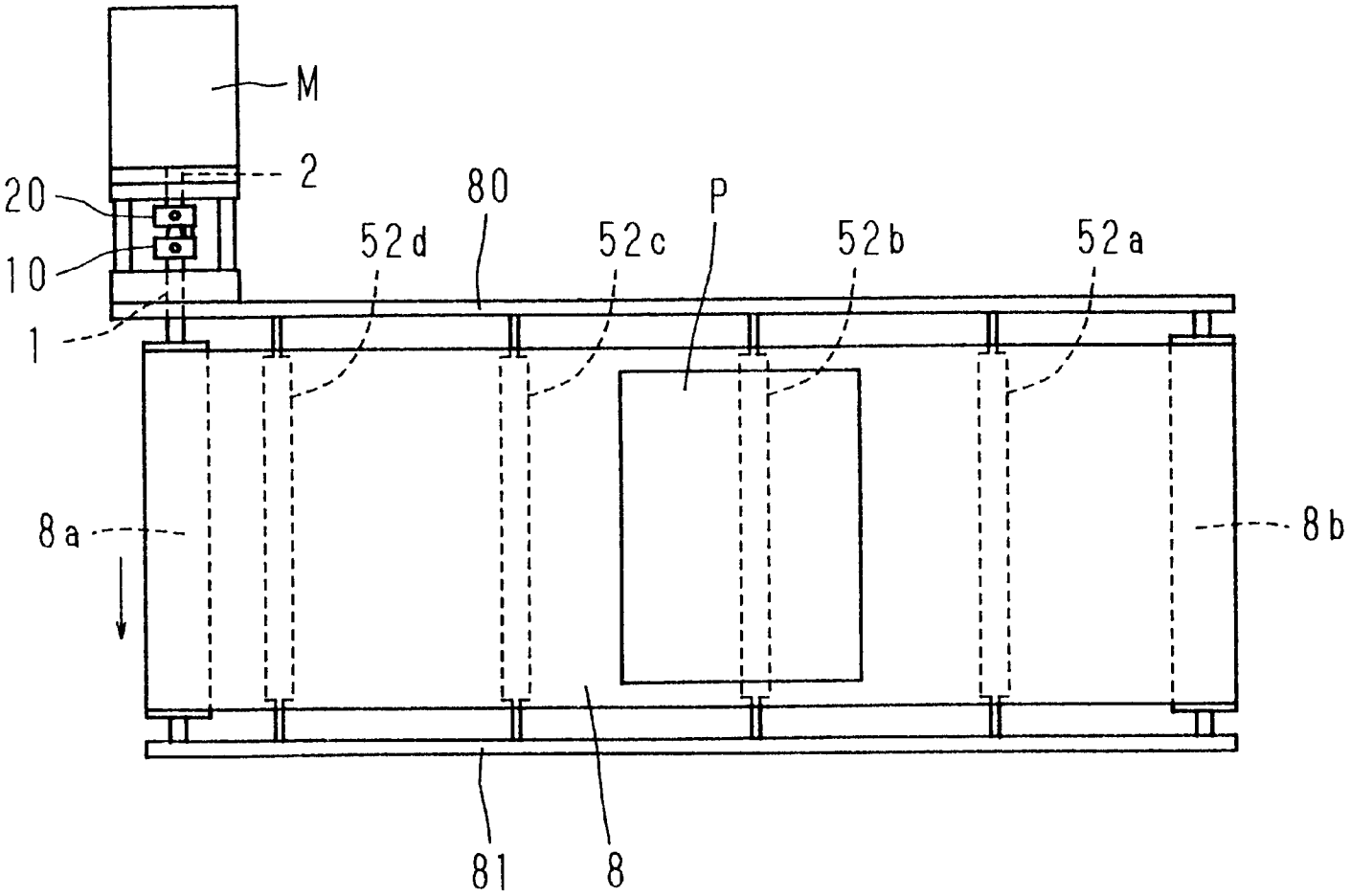
FIG. 3 is a plan view of the paper feeding apparatus including a rotation transfer device of the invention.

FIG. 3 is a plan view of the paper feeding apparatus including the rotation transfer device of the invention. The feed roller 8*a* and the driven roller 8*b* are supported in parallel to each other between a pair of supporting frames 80 and 81 together with the transfer devices 52*a*, 52*b*, 52*c* and 52*d* disposed between the rollers. The transfer belt 8 is wound around the feed roller 8*a* and the driven roller 8*b* with appropriate tension so as to be in contact with the transfer devices 52*a*, 52*b*, 52*c* and 52*d*. The paper feeding apparatus is fabricated in one unit together with the supporting frames 80 and 81, and the unit can be taken out of the outer housing 3 (shown in FIG. 2) by drawing it in the axial direction of the feed roller 8*a* as is shown with an arrow in the drawing. Also, the unit can be mounted in a predetermined position in the outer housing 3 by pushing it in the axial direction of the feed roller 8*a* with the supporting frame 80 positioned inward.

As is shown in FIG. 3, the feed roller 8*a* includes a roller shaft 1 projecting by an appropriate length from the inside supporting frame 80. A motor M for driving the feed roller 8*a* is fixed within the outer housing 3. A motor shaft 2 of the motor M opposes the roller shaft 1 substantially coaxially when the paper feeding apparatus is mounted. The shafts 1 and 2 are coaxially coupled with each other through a coupling member 10 provided on the roller shaft 1 and a coupling member 20 provided on the motor shaft 2, so that the feed roller 8*a* can be driven by the motor M.

The coupling between the roller shaft 1 and the motor shaft 2 can be released by drawing the paper feeding apparatus as described above. Such releasable coupling is realized by the rotation transfer device of the invention by using the roller shaft 1 as a driven shaft and the motor shaft 2 as a driving shaft.

Figure 4:
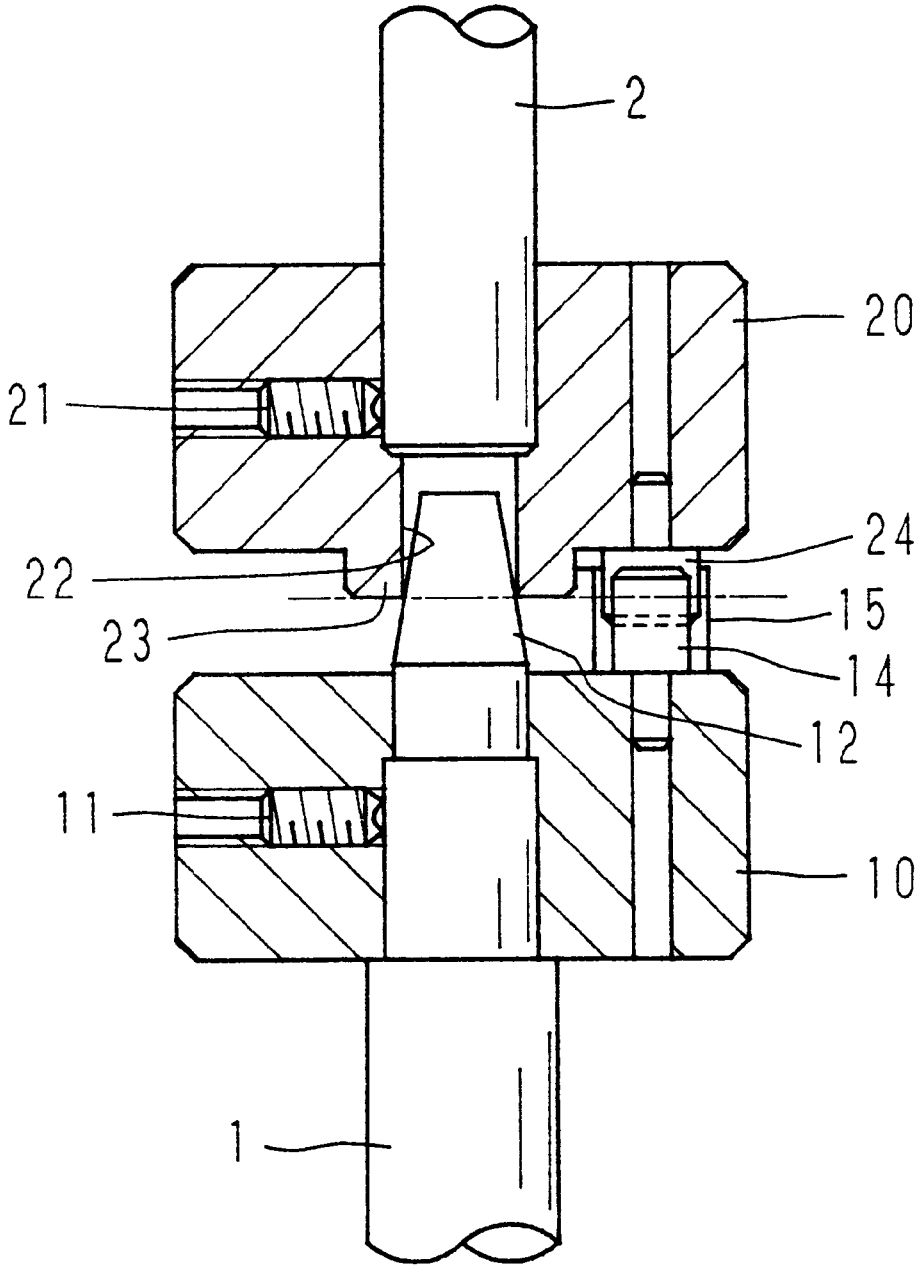
FIG. 4 is an enlarged sectional view of the rotation transfer device of the invention.
Figure 5:
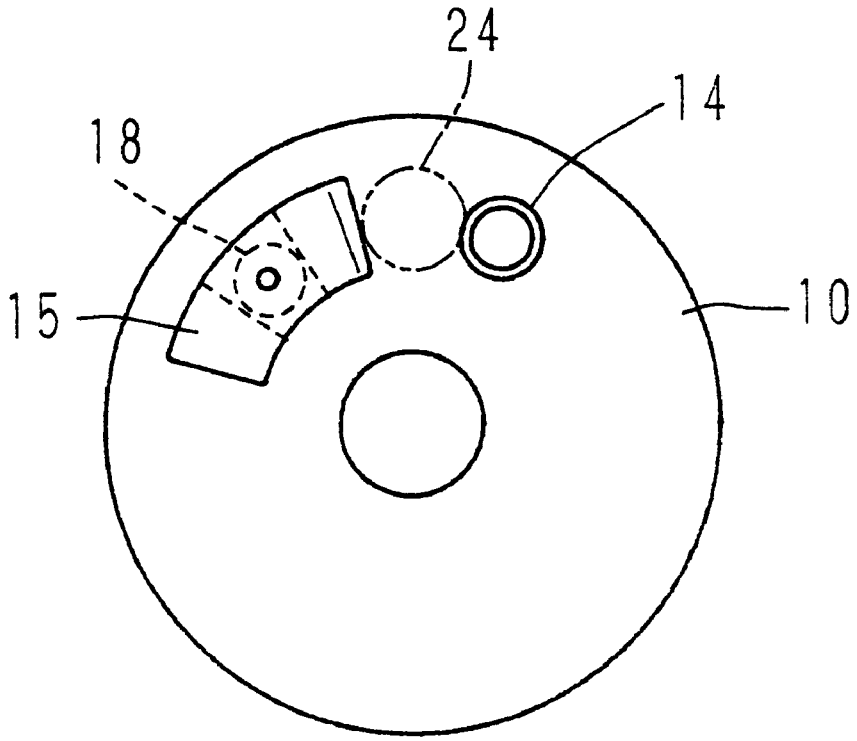
FIG. 5 is a front view of a coupling member provided on a roller shaft of FIG. 4.
Figure 6:
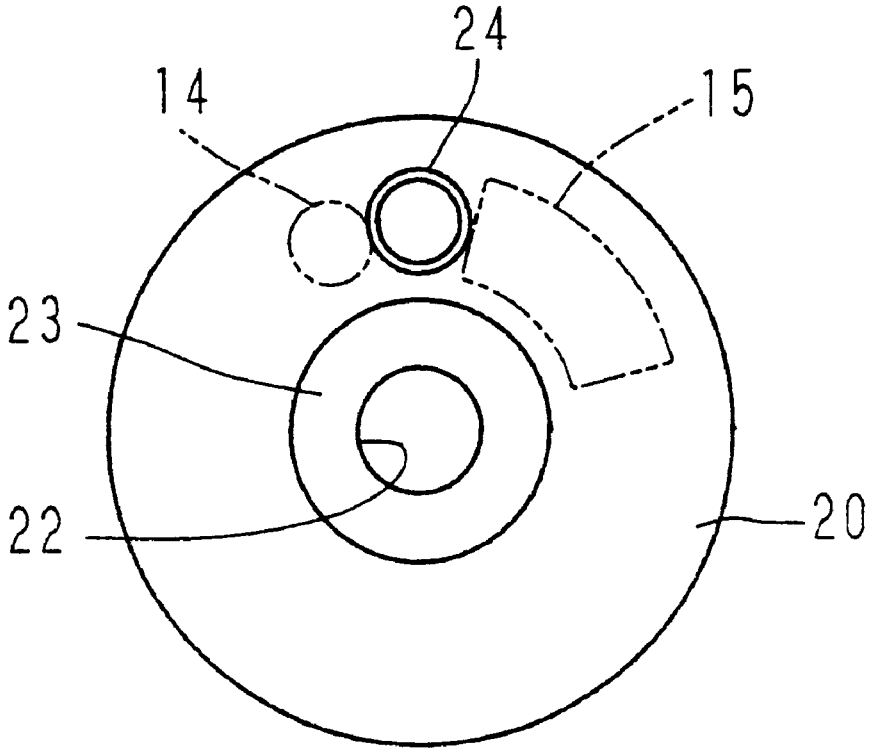
FIG. 6 is a front view of another coupling member provided on a motor shaft of FIG. 4.

FIG. 4 is an enlarged sectional view of the rotation transfer device of the invention, wherein the vicinity of the coupling between the roller shaft 1 and the motor shaft 2 is illustrated. Also, FIG. 5 is a front view of the coupling member 10 provided on the roller shaft 1 and FIG. 6 is a front view of the coupling member 20 provided on the motor shaft 2, wherein the end faces of the coupling members opposing each other are shown.

Figure 1:
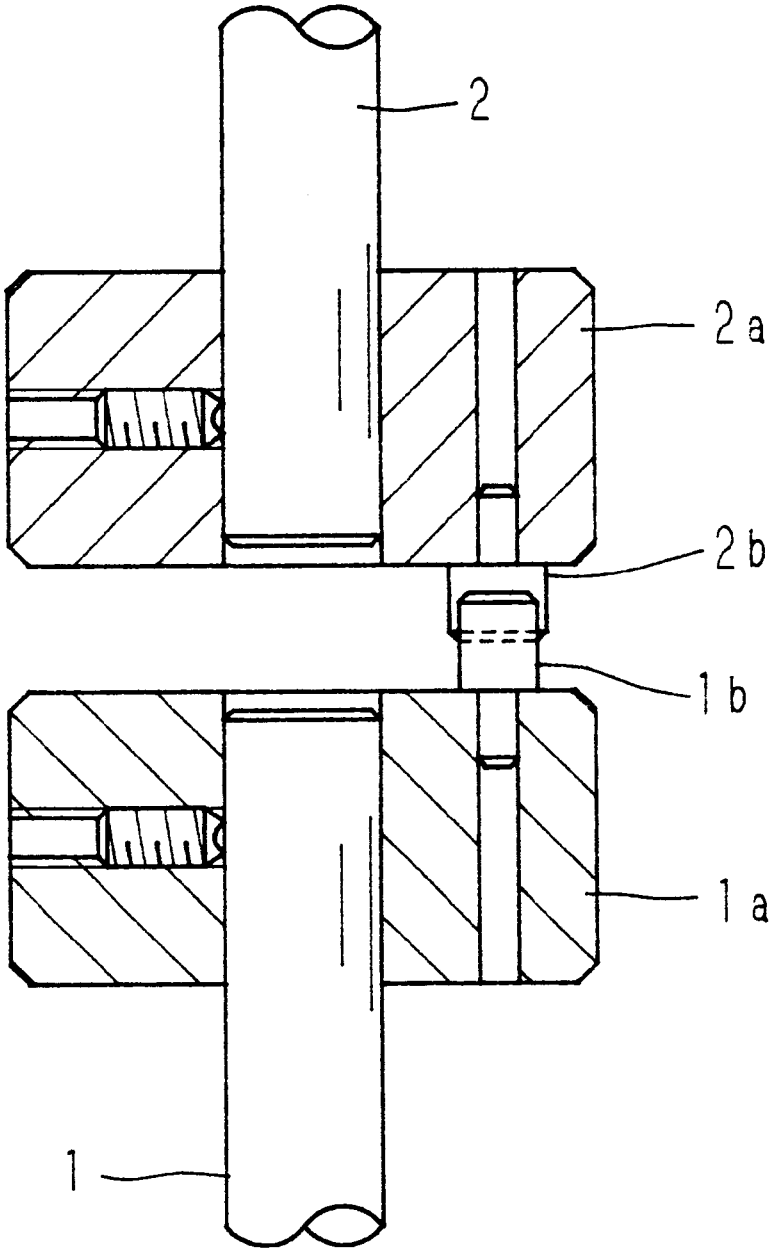
FIG. 1 PRIOR ART
FIG. 1 is a sectional view of a conventional rotation transfer device.

As is shown in the drawings, the coupling members 10 and 20 are both in the shape of a short cylinder having substantially the same diameter similarly to the corresponding conventional members shown in FIG. 1. Also, as is shown in FIG. 4, the coupling members 10 and 20 are fit around the ends of the roller shaft 1 and the motor shaft 2, respectively through mounting holes penetrating their axial centers, and are fixed with set screws 11 and 21, respectively so as not to be loosened.

The roller shaft 1 is projected from the end of the coupling member 10 by an appropriate length, and the projected portion is formed as a taper portion 12 having a smaller diameter toward its tip. The end of the motor shaft 2 is positioned so as not to reach the end face of the coupling member 20. The mounting hole for the motor shaft 2 is communicated with a positioning hole 22 having a smaller diameter in a position closer to the end face of the coupling member 20, and the positioning hole 22 is opened at the center of an elevated portion 23 elevated from the end face of the coupling member 20 by an appropriate length.

Owing to the aforementioned structure, when the roller shaft 1 is pushed in and moved close to the motor shaft 2 so as to be coupled with the motor shaft 2, the taper portion 12 at the tip of the roller shaft 1 is fit in the positioning hole 22 formed in the coupling member 20, and the circumferential surface of the taper portion 12 comes in contact with the opening edge of the positioning hole 22 as is shown in FIG. 4. Thus, the roller shaft 1 and the motor shaft 2 are coaxially positioned without a shift and inclination of their axial centers.

Also, on the opposing end faces of the coupling member 10 provided on the roller shaft 1 and the coupling member 20 provided on the motor shaft 2, transfer pins 14 and 24 are respectively disposed with their heads projected as transfer projections. The positions of the transfer pins 14 and 24 are respectively away from the axial centers of the roller shaft 1 and the motor shaft 2 by substantially the same distance. As a result, the head of the transfer pin 24, which is moved along a predetermined circle in accordance with the rotation of the coupling member 20 brought by the drive of the motor shaft 2, comes into a contact with the head of the transfer pin 14 as is shown in FIG. 4, and pushes the transfer pin 14 in the circumferential direction. Thus, the rotation of the motor shaft 2 is transferred to the coupling member 10 and the roller shaft 1.

Furthermore, as is shown in FIG. 4, the transfer pins 14 and 24 are in contact at substantially the same position in the axial direction as a point where the taper portion 12 and the opening edge of the positioning hole 22 are in contact. The contact points can be thus positioned because the positioning hole 22 is opened in the elevated portion 23 elevated from the end face of the coupling member 20 as described above.

The contact point between the transfer pins 14 and 24 works as a point of application of the rotation transferred from the motor shaft 2 to the roller shaft 1, and the contact point between the taper portion 12 and the positioning hole 22 works as a point of support in the coupling between the motor shaft 2 and the roller shaft 1. Accordingly, since the contact points are set at the same position in the axial direction, a force of the transfer pin 24 to push the transfer pin 14 is collected onto their rotation circle, and a component of the force does not affect the roller shaft 1 and the motor shaft 2. Thus, the rotation transfer can be stabilized.

Figure 7:
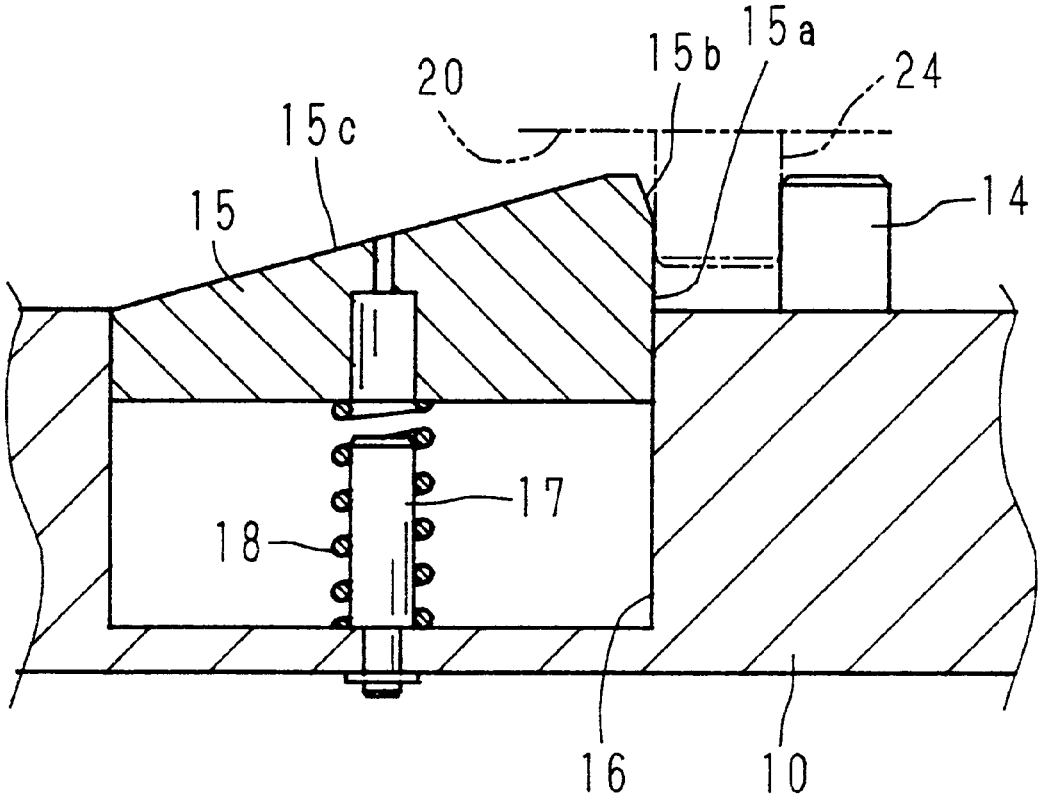
FIG. 7 is a sectional view for showing mounting of a positioning block of FIG. 5.

Furthermore, as is shown in FIG. 5, on the end face of the coupling member 10 provided on the roller shaft 1, a positioning block (positioning member) 15 movable in the axial direction is disposed on substantially the same circle as the transfer pin 14, and the positioning block 15 has a rectangular shape in a plan view curved along this circle. FIG. 7 is a sectional view for showing the mounting of the positioning block 15, in which the coupling member 10 is linearly expanded on the circle where the transfer pin 14 and the positioning block 15 are disposed.

As is shown in FIG. 7, the bottom of the positioning block 15 is fit in a guide hole 16 formed in the coupling member 10 in the corresponding shape, so that the positioning block 15 can be supported movably along the guide hole 16. At substantially the center of the bottom of the guide hole 16, a spring rod 17 is provided so as to substantially perpendicularly stand, and a spring 18 fit around the spring rod 17 is elastically in contact with the bottom of the guide hole 16 and the positioning block 15. Thus, the positioning block 15 is supplied with a spring force in a projecting direction (i.e., upward in the drawing) by the spring 18.

The tip of the positioning block 15 projecting from the end face of the coupling member 10 opposes, at one side, the transfer pin 14 with a predetermined distance in the peripheral direction as is shown in FIG. 7. At the side opposing the transfer pin 14, the positioning block 15 has a constraint face 15*a* rising substantially perpendicular to the end face of the coupling member 10 and a guide face 15*b* in a tapered shape inclined toward the other side. Toward the other side, the positioning block 15 is continuously formed without any step from the end face, so as to have a press face 15*c* in a gently tapered shape more highly projected toward the tip of the guide face 15*b*.

The opposing distance between the transfer pin 14 and the positioning block 15 is set to be substantially the same as the diameter of the head of the transfer pin 24, which is shown with a two-dot chain line in FIG. 7, provided on the other coupling member 20. Therefore, when the transfer pin 14 pushes the transfer pin 24 for the rotation transfer, the transfer pin 24 is nipped between the transfer pin 14 and the constraint face 15*a* of the positioning block 15, so that the transfer pin 24 is constrained not to move toward and away from the transfer pin 14. In FIG. 5 showing the coupling member 10 provided on the roller shaft 1, the transfer pin 24 of the coupling member 20 provided on the motor shaft 2 is shown with a two-dot chain line, and in FIG. 6 showing the coupling member 20 provided on the motor shaft 2, the transfer pin 14 and the positioning block 15 of the coupling member 10 provided on the roller shaft 1 are shown with two-dot chain lines. The nip of the transfer pin 24 between the transfer pin 14 and the positioning block 15 can be obvious from these drawings.

As described above, when the paper P is fed by the operation of the transfer belt 8 brought by the rotation of the feed roller 8*a* caused by the rotation of the roller shaft 1, rotation torque including a variation component is applied, in the reverse direction to the rotation caused by the driving motor M, to the feed roller 8*a* due to a frictional force caused between the paper P to be fed and the transfer belt 8 and other components relating to the feed. According to this invention, the transfer pin 24 on the side of the motor shaft 2 is constrained in the peripheral direction between the transfer pin 14 and the constraint face 15*a* of the positioning block 15 on the side of the roller shaft 1. Therefore, even when the rotation torque is applied, the transfer pin 14 on the side of the roller shaft 1 can be prevented from moving away from the transfer 24 on the side of the motor shaft 2 due to the constraint brought by the positioning block 15.

As a result, the transfer pins 14 and 24 can be in a satisfactory contact with each other, thereby preventing the rotation irregularity of the feed roller 8*a* and the transfer belt 8 from being caused by the rotation torque. Thus, the paper P can be accurately fed through the rotation, and a good image free from dislocation of the transferred images of the sensitive drums 5*a*, 5*b*, 5*c* and 5*d* corresponding to the respective colors, namely, free from color dislocation, can be formed.

On the other hand, the coupling member 10 provided on the roller shaft 1 and the coupling member 20 provided on the motor shaft 2 are not constrained at all in the axial direction, and the coupling therebetween can be easily released by pulling the roller shaft 1 in the axial direction. Accordingly, the feed unit including the transfer belt 8, the feed roller 8*a*, the driven roller 8*b* and the supporting frames 80 and 81 can be taken out of the outer housing 3 of the image forming apparatus by pulling it in the axial direction of the feed roller 8*a*. Thus, the maintenance, inspection and exchange of the respective components of the feed unit can be eased.

Also, by pushing the feed unit having been taken out in the axial direction of the feed roller 8*a* into the outer housing 3, the coupling members 10 and 20 can come close to each other, and the roller shaft 1 and the motor shaft 2 can be coupled, so that the rotation can be transferred from the motor M to the feed roller 8*a* as described above. At this point, the taper portion 12 at the tip of the roller shaft 1 is fit in the positioning hole 22 formed in the coupling member 20, so that the roller shaft 1 and the motor shaft 2 can be coaxially positioned without a shift and inclination of the axial centers as described above.

In pushing the feed unit, there is no need to position the transfer pin 14 on the coupling member 10 against the transfer pin 24 on the coupling member 20 in the peripheral direction. After the feed unit is pushed in, the transfer pins 14 and 24 can come into contact with each other by the operation of the positioning block 15 through one rotation at most obtained by the motor M. Thus, the rotation can be transferred from the motor shaft 2 to the roller shaft 1.

Figure 8A:
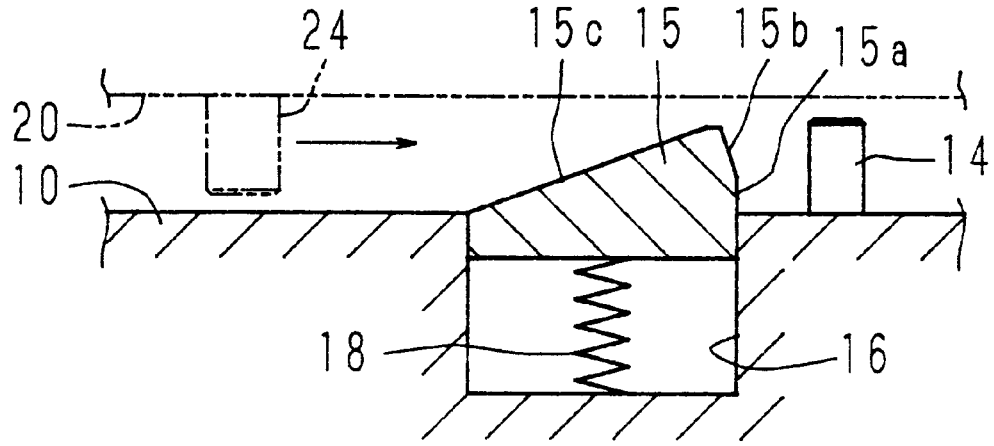
FIGS. 8A, 8B and 8C are explanatory diagrams for illustrating an operation of the positioning block of FIG. 5.
Figure 8B:
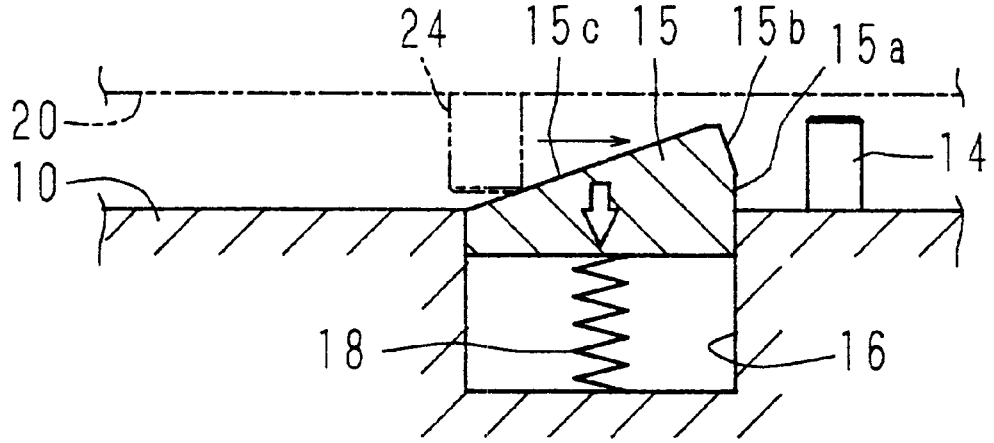
Figure 8C:
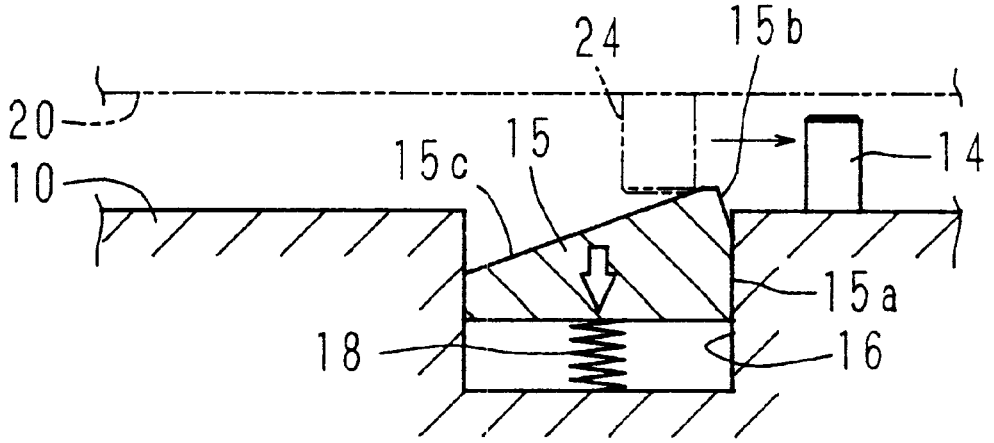

FIGS. 8A, 8B and 8C illustrate the operation of the positioning block 15, in which the coupling members 10 and 20 are linearly expanded on the circle where the transfer pins 14 and 24 and the positioning block 15 are disposed similarly to FIG. 7.

FIG. 8A shows a state where the transfer pin 24 on the coupling member 20 is positioned away from the transfer pin 14 on the coupling member 10 after the feed unit is pushed in. When the motor M is driven in this state, the coupling member 20 is rotated in a direction shown with an arrow in FIG. 8A, and the transfer pin 24 on the coupling member 20 moves close to the transfer pin 14 on the coupling member 10 through this rotation. The positioning block 15 is positioned upstream of the rotation and opposes the transfer pin 14, and the transfer pin 24 moved through the rotation reaches the positioning block 15 as is shown in FIG. 8B, and comes in contact with the gently tapered press face 15*c* formed on the side of the positioning block 15 closer to the transfer pin 24.

Since the transfer pin 24 thus comes in contact with the positioning block 15, the positioning block 15 is pushed in the same direction as the movement of the transfer pin 24. At the same time, a component of the pushing force makes the positioning block 15 to recess into the guide hole 16 against the spring force of the spring 18 as is shown in FIG. 8C, so that the transfer pin 24 can move further toward the transfer pin 14. The transfer pin 24 thus reaches the transfer pin 14 on the coupling member 10, and is constrained at the point where it is in contact with the transfer pin 14. At this point, since the transfer pin 24 is away from the press face 15*c*, the positioning block 15 is pushed up above the end face of the coupling member 10 by the spring force of the spring 18, so that the constraint face 15*a* can come into a contact with the transfer pin 24 on the opposite side of the transfer pin 14. Thus, the constraint as is shown in FIG. 7 can be attained.

The transfer pin 24 having passed by the press face 15*c* slides on the tapered guide face 15*b* formed on the side of the positioning block 15 opposing the transfer pin 14, so that the positioning block 15 can be slowly pushed up by the spring force of the spring 18. Thus, the guide face 15*b* functions to guide the transfer pin 24 to the space between the constraint face 15*a* of the positioning block 15 and the transfer pin 14. In this manner, the constraint as is shown in FIG. 7 can be definitely attained, and the rotation can be transferred to the feed roller 8*a* without the rotation irregularity as described above.

Figure 9:
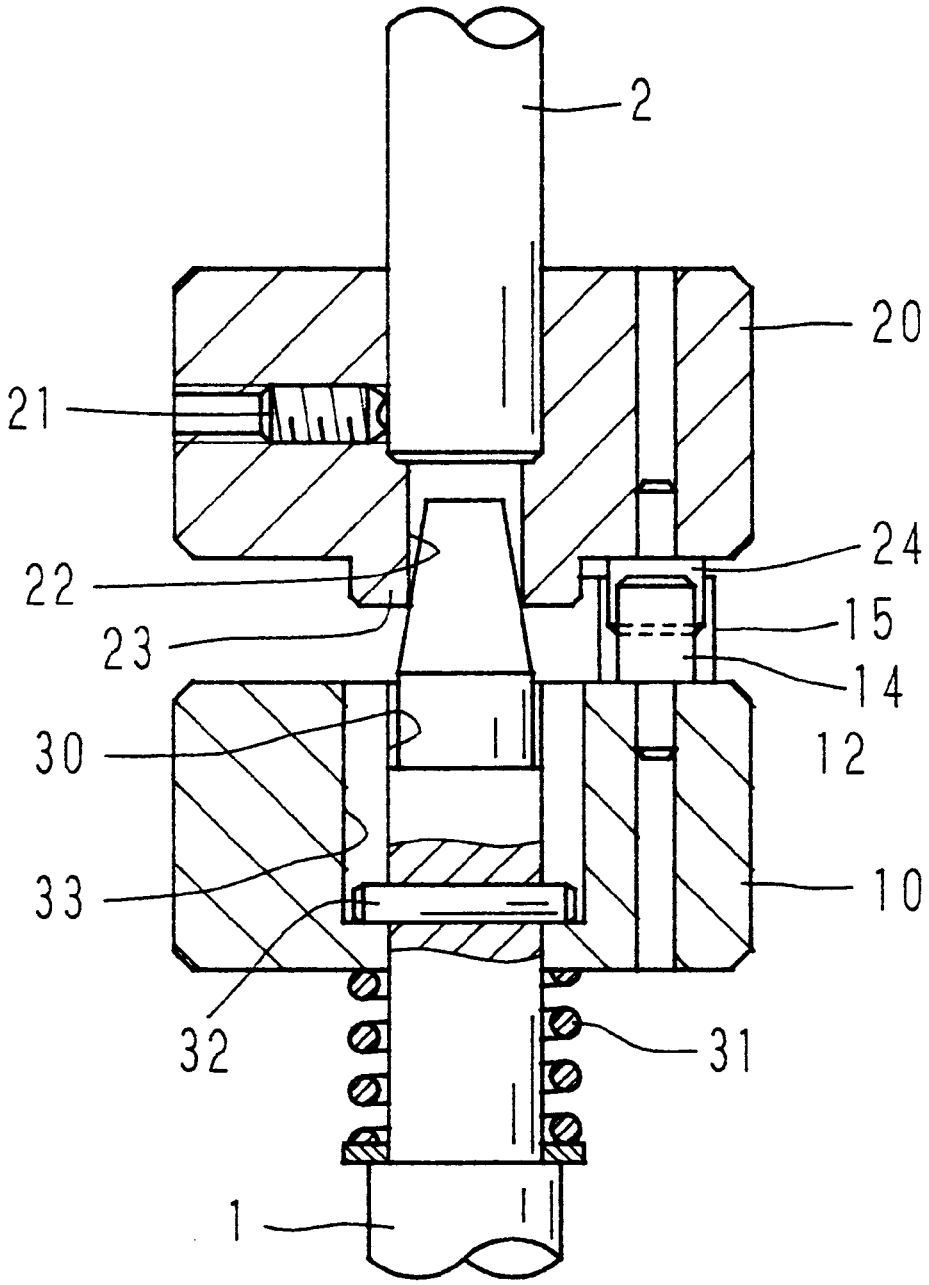
FIG. 9 is an enlarged sectional view of a rotation transfer device according to another embodiment of the invention.

FIG. 9 is an enlarged sectional view for showing another embodiment of the rotation transfer device of the invention, wherein the vicinity of the coupling between a roller shaft 1 and a motor shaft 2 is shown similarly to FIG. 4. The roller shaft 1 and the motor shaft 2 of FIG. 9 are coupled with each other through coupling members 10 and 20 respectively provided on the roller shaft 1 and the motor shaft 2 as in the aforementioned embodiment shown in FIG. 4. Similarly, transfer pins 14 and 24 respectively provided on the opposing faces of the coupling members 10 and 20 come in contact with each other on their rotation circle, so that the rotation can be transferred from the motor shaft 2 to the roller shaft 1. Also, a taper portion 12 at the tip of the roller shaft 1, a positioning hole 22 formed in the coupling member 20 and a positioning block 15 on the coupling member 10 are similarly provided, so that the rotation can be stably transferred from the motor shaft 2 to the roller shaft 1 without the rotation irregularity.

As a characteristic of this embodiment, the coupling member 10 provided on the roller shaft 1 is penetrated by the roller shaft 1 through a hole 30 formed in the axial center thereof so as to be movable along the axial direction, and is pushed toward the coupling member 20 by a spring 31, working as the second force applying means, fit around the roller shaft 1. The roller shaft 1 is provided with a guide pin 32 extending in the radial direction of the roller shaft 1, and the ends of the guide pin 32 projecting from the periphery of the roller shaft 1 are engaged with guide grooves 33 formed at corresponding positions in the axial direction on the inside wall of the hole 30.

In this manner, the coupling member 10 can move in the axial direction within a range of the length of the guide grooves 33 with its rotation constrained by the roller shaft 1. When the coupling member 10 opposes the coupling member 20, the coupling member 10 is moved toward the coupling member 20 by the spring force of the spring 31. Accordingly, even when the feed unit including the feed roller 8*a* is not sufficiently pushed in, with a distance between the coupling members 10 and 20 remaining too large, the coupling member 10 can be moved to come close to the coupling member 20 so as to make the distance sufficiently small for allowing the transfer pins 14 and 24 to come in contact each other. When the transfer pins 14 and 24 thus come in contact with each other, the rotation can be transferred. In this manner, a state where the rotation cannot be transferred due to insufficient assembly can be avoided.

In the aforementioned embodiments, the positioning block 15 is provided on the coupling member 10 on the roller shaft 1 serving as the driven shaft, but it goes without saying that the positioning block can be provided on the coupling member 20 on the motor shaft 2 serving as the driving shaft.

Also in the aforementioned embodiments, the rotation transfer device is applied to the paper feeding apparatus in which paper P to be fed is fed by the transfer belt 8 extended along the feed path, but the rotation transfer device can be applied to a paper feeding apparatus in which paper P is directly fed by using the rotation of a roller. Also, the rotation transfer device can be applied to a roller in a wide sense for indirectly feeding paper P by its rotation, such as the sensitive drums 5*a*, 5*b*, 5*c* and 5*d*. Furthermore, the application of the rotation transfer device of the invention is not limited to the image forming apparatus as described in the embodiments but the device can be applied to a paper feeding system used in another type of apparatus in which paper is required to be accurately fed.

As described so far, in the rotation transfer device of this invention, the driven shaft and the driving shaft are respectively provided with the coupling members and the coupling members are provided with the transfer projections coming in contact with each other in the position away from the axial centers, so that the driven shaft can be driven through the contact of the transfer projections. Therefore, the driven shaft can be coupled with and removed from the driving shaft by pushing and pulling the driven shaft in the axial direction. As a result, the maintenance, inspection and exchange of the composing members can be eased.

Furthermore, one of the transfer projections is constrained by begin clipped between the other transfer projection and the positioning member in the peripheral direction. Therefore, the rotation irregularity can be effectively prevented from being caused by the reverse rotation torque applied by a function from the driven shaft.

The positioning member is provided movably against the coupling member, so as to allow the transfer projection on the other coupling member to move in the peripheral direction by its movement. When the transfer projections come in contact with each other, the positioning member is moved in the projecting direction by a force applied by the force applying means so as to nip the transfer projection on the opposing coupling member. Therefore, the driven shaft and the driving shaft can be coupled without positioning the transfer projections by merely pushing the driven shaft in the axial direction. Thus, re-assembly after the maintenance, inspection and exchange can be conducted easily and definitely.

Also, in the rotation transfer device of this invention, when the driven shaft is brought close to the driving shaft for the coupling, the taper portion formed at the tip of one of the shafts can be fit in the positioning hole formed at the axial center of the couping member on the other shaft. Therefore, the driven shaft and the driving shaft can be coaxially coupled with each other without a shift and inclination of their axial centers, resulting in attaining definite transfer of the rotation.

Moreover, in the rotation transfer device of the invention, the point where the taper portion is fit in the positioning hole, working as a point of support in the coupling between the driven shaft and the driving shaft, is set at substantially the same position in the axial direction as the point where the transfer projections are in contact with each other, working as a point of application of the rotation power transferred from the driving shaft to the driven shaft. Therefore, a component of the power transferred from the driving shaft to the driven shaft is not applied to the driving shaft and the driven shaft, resulting in attaining stable transfer.

Furthermore, in the rotation transfer device of the invention, the coupling member on the driven shaft or the driving shaft is provided movably in the axial direction so as to be pushed toward the other coupling member. Therefore, when the driven shaft is brought close to the driving shaft for the coupling, one of the coupling members is moved in the axial direction toward the other coupling member by a force applied by the force applying means. Thus, the transfer projections on the both coupling members can be in contact with each other, so that the rotation can be transferred. In this manner, a state where the rotation cannot be transferred due to incomplete positioning between the driven shaft and the driving shaft can be avoided.

Also, in the paper feeding apparatus of the invention, the rotation transfer from the driving motor to the feed roller for paper is realized by using the rotation transfer device described above. Therefore, the feed unit including the feed roller can be taken out by drawing it in the axial direction. Thus, the maintenance, inspection and exchange of the respective members in the feed unit can be eased, and the feed roller can be driven without the rotation irregularity. As a result, paper to be fed can be fed without dislocation.

Furthermore, in the image forming apparatus of the invention, the paper feed from the paper supply unit to the paper discharge unit is realized by using the paper feeding apparatus described above. Therefore, paper can be fed to the print unit disposed on the feed path without dislocation, and the printing quality of the print unit can be improved. In addition, the feed unit including the feed roller can be taken out by drawing it in the axial direction, and the maintenance, inspection and exchange of the composing members relating the feed can be eased.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A rotation transfer device, comprising:

a driving shaft;

a driven shaft;

coupling members respectively provided on ends of the driving shaft and the driven shaft, through which the driven shaft and the driving shaft are removably coupled with each other;

transfer projections respectively projected from opposing faces of the coupling members on a common circle away from axial centers of the coupling members, which are brought to a contact with each other for rotation transfer;

a positioning member provided on one of the coupling members movably toward and away from the opposing face of the other coupling member, which is moved in a projecting direction to constrain movement of the transfer projection on the opposing coupling member in a direction away from the transfer projection on the coupling member having the positioning member, and is moved in a recessing direction to allow movement of the transfer projection of the opposing coupling member in a direction toward the transfer projection on the coupling member having the positioning member; and force applying means for applying a force to the positioning member in the projecting direction.

2. The rotation transfer device according to claim 1, wherein one of the coupling members provided on the driven shaft or the driving shaft includes a taper portion projected from an axial center thereof with a smaller diameter toward a tip thereof, and the other coupling member includes a positioning hole formed at an axial center thereof to be fit with the taper portion when the driven shaft and the driving shaft are coupled.

3. The rotation transfer device according to claim 2, wherein a point where the taper portion is fit in the positioning hole is in substantially the same position in the axial direction as a point where the transfer projections are in contact with each other.

4. The rotation transfer device according to claim 3, wherein one of the coupling members includes second force applying means provided movably in the axial direction of the corresponding shaft, the second force applying means applying a force to the coupling member including the second force applying means in a direction toward the other coupling member.

5. The rotation transfer device according to claim 2, wherein one of the coupling members includes second force applying means provided movably in an axial direction of the corresponding shaft, the second force applying means applying a force to the coupling member including the second force applying means in a direction toward the other coupling member.

6. The rotation transfer device according to claim 1, wherein one of the coupling members includes second force applying means provided movably in an axial direction of the corresponding shaft, the second force applying means applying a force to the coupling member including the second force applying means in a direction toward the other coupling member.

7. A paper feeding apparatus, including:

a feed path for paper;

a driven shaft working as a roller shaft of a feed roller facing on the feed path;

a driving shaft working as a motor shaft of a motor for driving the feed roller, the driving shaft rotating the feed roller by the driving thereof for directly or indirectly feeding the paper;

coupling members respectively provided on ends of the driving shaft and the driven shaft, through which the driven shaft and the driving shaft are removably coupled with each other;

transfer projections respectively projected from opposing faces of the coupling members on a common circle away from axial centers of the coupling members, which are brought to a contact with each other for rotation transfer;

a positioning member provided on one of the coupling members movably toward and away from the opposing face of the other coupling member, which is moved in a projecting direction to constrain movement of the transfer projection on the opposing coupling member in a direction away from the transfer projection on the coupling member having the positioning member, and is moved in a recessing direction to allow movement of the transfer projection of the opposing coupling member in a direction toward the transfer projection on the coupling member having the positioning member; and force applying means for applying a force to the positioning member in the projecting direction.

8. The paper feeding apparatus according to claim 7, wherein one of the coupling members provided on the driven shaft or the driving shaft includes a taper portion projected from an axial center thereof with a smaller diameter toward a tip thereof, and the other coupling member includes a positioning hole formed at an axial center thereof to be fit with the taper portion when the driven shaft and the driving shaft are coupled.

9. The paper feeding apparatus according to claim 8, wherein a point where the taper portion is fit in the positioning hole is in substantially the same position in the axial direction as a point where the transfer projections are in contact with each other.

10. The paper feeding apparatus according to claim 9, wherein one of the coupling members includes second force applying means provided movably in the axial direction of the corresponding shaft, the second force applying means applying a force to the coupling member including the second force applying means in a direction toward the other coupling member.

11. The paper feeding apparatus according to claim 8, wherein one of the coupling members includes second force applying means provided movably in an axial direction of the corresponding shaft, the second force applying means applying a force to the coupling member including the second force applying means in a direction toward the other coupling member.

12. The paper feeding apparatus according to claim 7, wherein one of the coupling members includes second force applying means provided movably in an axial direction of the corresponding shaft, the second force applying means applying a force to the coupling member including the second force applying means in a direction toward the other coupling member.

13. An image forming apparatus, comprising:

a feed path for paper disposed between a paper feed unit and a paper discharge unit and including a print unit for forming an image;

a driven shaft working as a roller shaft of a feed roller facing on the feed path;

a driving shaft working as a motor shaft of a motor for driving the feed roller, the driving shaft rotating the feed roller by the driving thereof for directly or indirectly feeding the paper;

coupling members respectively provided on ends of the driving shaft and the driven shaft, through which the driven shaft and the driving shaft are removably coupled with each other;

transfer projections respectively projected from opposing faces of the coupling embers on a common circle away from axial centers of the coupling members, which are brought to a contact with each other for rotation transfer;

a positioning member provided on one of the coupling members movably toward and away from the opposing face of the other coupling member, which is moved in a projecting direction to constrain movement of the transfer projection on the opposing coupling member in a direction away from the transfer projection on the coupling member having the positioning member, and is moved in a recessing direction to allow movement of the transfer projection of the opposing coupling member in a direction toward the transfer projection on the coupling member having the positioning member; and force applying means for applying a force to the positioning member in the projecting direction.

14. The image forming apparatus according to claim 13, wherein one of the coupling members provided on the driven shaft or the driving shaft includes a taper portion projected from an axial center thereof with a smaller diameter toward a tip thereof, and the other coupling member includes a positioning hole formed at an axial center thereof to be fit with the taper portion when the driven shaft and the driving shaft are coupled.

15. The image forming apparatus according to claim 14, wherein a point where the taper portion is fit in the positioning hole is in substantially the same position in the axial direction as a point where the transfer projections are in contact with each other.

16. The image forming apparatus according to claim 15, wherein one of the coupling members includes second force applying means provided movably in the axial direction of the corresponding shaft, the second force applying means applying a force to the coupling member including the second force applying means in a direction toward the other coupling member.

17. The image forming apparatus according to claim 14, wherein one of the coupling members includes second force applying means provided movably in an axial direction of the corresponding shaft, the second force applying means applying a force to the coupling member including the second force applying means in a direction toward the other coupling member.

18. The image forming apparatus according to claim 13, wherein one of the coupling members includes second force applying means provided movably in an axial direction of the corresponding shaft, the second force applying means applying a force to the coupling member including the second force applying means in a direction toward the other coupling member.

* * * * *